US005697341A

United States Patent [19]

Ausman et al.

[11] Patent Number: 5,697,341

[45] Date of Patent: Dec. 16, 1997

[54] FILL METERED HYDRAULICALLY ACTUATED FUEL INJECTION SYSTEM AND METHOD OF FUEL INJECTION

[75] Inventors: Thomas G. Ausman, Metamora, Ill.; Frederick A. Camplin, Cary, N.C.; Michael P. Harmon, Dunlap, Ill.; Douglas E. Longman, Naperville, Ill.; Lianghe Zuo, Normal, Ill.

[73] Assignee: Caterpillar, Inc., Peopia, Ill.

[21] Appl. No.: 559,867

[22] Filed: Nov. 20, 1995

[51] Int. Cl.[6] ..... F02M 37/04

[52] U.S. Cl. ..... 123/446; 123/447

[58] Field of Search ..... 123/446, 447, 123/467, 500, 501

[56] References Cited

U.S. PATENT DOCUMENTS

| | | | |
|---|---|---|---|
| Re. 33,270 | 7/1990 | Beck et al. | 123/447 |
| 4,485,789 | 12/1984 | Walter et al. | 123/467 |
| 4,699,320 | 10/1987 | Sisson et al. | 239/90 |
| 4,826,081 | 5/1989 | Zwick | 239/91 |
| 4,934,599 | 6/1990 | Hasagawa | 238/88 |
| 5,020,498 | 6/1991 | Linder et al. | 123/450 |
| 5,094,397 | 3/1992 | Peters et al. | 239/88 |
| 5,121,730 | 6/1992 | Ausman et al. | 123/467 |
| 5,191,867 | 3/1993 | Glassey | 123/446 |
| 5,323,964 | 6/1994 | Doszpoly et al. | 239/95 |
| 5,377,636 | 1/1995 | Rix | 123/446 |
| 5,460,133 | 10/1995 | Perr | 123/446 |
| 5,499,608 | 3/1996 | Meister et al. | 123/467 |
| 5,558,067 | 9/1996 | Blizzard | 123/446 |

FOREIGN PATENT DOCUMENTS

| | | |
|---|---|---|
| 2099078 | 12/1982 | United Kingdom . |
| 2275739 | 9/1994 | United Kingdom . |
| 2278648 | 12/1994 | United Kingdom . |
| 93/13309 | 7/1993 | WIPO . |

*Primary Examiner*—Carl S. Miller

[57] ABSTRACT

The fill metered hydraulically actuated fuel injection system of the present invention utilizes an actuation fluid, preferably lubricating oil, as its actuation medium that is separate and different from the fuel fluid which is actually injected into the engine. Injectors according to the present invention are hydraulically actuated and include a conventional VOP type needle check, and fuel is pressurized by a plunger driven by an intensifier piston. The end of each injection event is achieved when the plunger and piston reach the end of their strokes, which provides for an abrupt end to each injection event. An abrupt end to injection is further accomplished by providing a pressure relief passage in the plunger that relieves pressure acting on the needle check at the end of injection in order to both quickly dissipate residual fuel pressure and allow the needle check to close more rapidly. Fuel is metered into the injector either by biasing the plunger with a return spring or by pressurizing the fuel to hydraulically push the plunger in a retracting direction between injection events.

22 Claims, 8 Drawing Sheets

10'
123
122
11
119
118
111
116
112
114
115
113
117
118
$S_9$
$S_1$
$S_2$
$S_3$
$S_4$
$S_5$
$S_6$
$S_7$
$S_8$
$S_{10}$
$S_{11}$
103
121
110
109
108
120
123
101
102

1
SOLENOID CONTROL
0
TIME

END OF STROKE
PLUNGER / PISTON POSITION
RETRACTED
C
a
A
B
BB
TIME

MAX
FUEL SUPPLY MASS FLOW
0
TIME

MAX
INJECTION MASS FLOW
0
TIME 10
11'
112
113
114
115
116
117
118
119
120
121
122
123
124
101
102
103
108
109
110
111
S1
S2
S3
S4
S5
S6
S7
S8
S9
S10

NON-REVERSED ACTUATION FLUID SUPPLY

REVERSED ACTUATION FLUID SUPPLY

FILL METERED HYDRAULICALLY ACTUATED FUEL INJECTION SYSTEM AND METHOD OF FUEL INJECTION

TECHNICAL FIELD

The present invention relates generally to hydraulically actuated fuel injection systems, and more particularly to hydraulically actuated fuel injectors with the ability to meter a desired amount of fuel into the injector between each injection event.

BACKGROUND ART

Examples of fill metered unit injectors are shown in U.S. Pat. No. 5,020,498 issued to Linder et al. on Jun. 4, 1991 and British Patent No. 2,099,078A issued to Komatsu and having a filing date of May 14, 1982. In both Linder et al. and Komatsu, a single fluid, namely fuel fluid, is used as both a hydraulic actuation medium and the fuel to be injected into the combustion chamber of the engine. Linder et al. shows a fuel injection apparatus having a VOP type of needle check and what appears to be an intensifier piston method of raising fuel pressure to initiate injection. This reference teaches the use of a spring actuated intensifier piston that is compressed between each injection event by hydraulic fuel pressure acting in opposition to the spring. Fuel is metered into the Linder et al. injector by hydraulically lifting the intensifier piston against the force produced by the actuation spring. The desired amount of fuel is metered into the injector by stopping the hydraulic lift of the intensifier piston at a desired location corresponding to the desired amount of fuel to be injected in the next injection event. Each injection event ends when the piston reaches the end of its stroke. Unfortunately, Linder et al. suffers from known problems due to its use of fuel as both a hydraulic actuation medium and injection medium.

British Komatsu shows a hydraulically actuated fuel injector that teaches fuel metering via selectively relieving pressure on the top of the intensifier piston after each injection event to draw into the pressurization chamber the desired amount of fuel for the next injection event. This reference teaches the use of a compound rotary valve to control the timing and duration of when the intensifier cavity is open to either high pressure actuation fuel or a low pressure fuel drain. Because this reference teaches the use of a single fluid for both hydraulic actuation and for injection into the engine, it suffers from a number of the same drawbacks as Linder et al., including plumbing complexity within the injector and the associated dangers of utilizing flammable fluid as the actuation medium flowing in supply pipes around the engine at relatively high pressures.

The present invention is directed to overcoming one or more of the problems as set forth above.

DISCLOSURE OF THE INVENTION

In one aspect of the present invention, a hydraulically actuated fuel injector includes an injector body having an actuation fluid cavity that opens to an actuation fluid inlet, an actuation fluid drain, and a piston bore. The injector body also includes a plunger bore that opens to a nozzle chamber and a fuel supply passage. Finally, the nozzle chamber opens to a nozzle outlet that opens to the combustion chamber within the engine. A control valve is mounted in the injector body and is moveable between a first position that opens the actuation fluid inlet and closes the actuation fluid drain, and a second position that closes the actuation fluid inlet. An intensifier piston is positioned to reciprocate in the piston bore between an upper position and a lower position. A plunger, having a side surface extending between a contact end and a pressure face end, is positioned to reciprocate in the plunger bore between an advanced position and a retracted position.

A portion of the plunger bore and the pressure face end of the plunger define a fuel pressurization chamber that opens to the nozzle chamber. A needle check is positioned to reciprocate in the nozzle chamber between a closed position that closes the nozzle outlet and an open position that opens the nozzle outlet. The needle check includes a hydraulic lift surface exposed to the nozzle chamber. The injector includes some means, such as a spring, for biasing the needle check toward its closed position. The intensifier piston has a single hydraulic actuation surface, and said surface is exposed to the actuation fluid cavity within the injector body. Finally, the plunger is capable of stopping at a metered position between its retracted position and its advanced position when forces—including hydraulic forces—acting on the plunger balance forces acting on the intensifier piston.

In another embodiment of the present invention, a method of fuel injection is set forth using a fuel injector having most of the features described above. The method includes connecting the actuation fluid inlet of the injector to a source of high pressure actuation fluid. Next, the actuation fluid drain is connected to a low pressure return line. The fuel supply passage of the injector is then connected to a source of fuel fluid, which is separate and different from the actuation fluid. Each injection event is initiated by opening the actuation fluid inlet to flow of high pressure actuation fluid to hydraulically push the intensifier piston against the plunger until both are moving together in a forward direction. So that hydraulic pressure can build, the actuation fluid drain is closed before or about contemporaneously with the initiation of an injection event.

After the fuel injection event, the actuation fluid inlet is closed to further flow of high pressure actuation fluid. Next, the actuation fluid drain is opened and fuel fluid is allowed to flow into the fuel pressurization chamber within the injector body as the plunger/piston retract after the injection event. In one embodiment, the plunger is hydraulically pushed against the intensifier piston using pressurized fuel until both are moving together in a return direction opposite to the forward direction. Alternatively, the plunger/piston could retract under the action of a return spring. The plunger is stopped after a desired amount of fuel for a subsequent injection event has metered into the injector body through the fuel supply passage.

In still another embodiment of the present invention, a fuel injection system includes a source of high pressure actuation fluid, a low pressure actuation fluid reservoir, and a source of fuel fluid. This system includes a hydraulically actuated fuel injector having an injector body with an actuation fluid cavity that opens to an actuation fluid inlet, an actuation fluid drain, and a piston bore. The injector body also has a plunger bore that opens to a nozzle chamber and a fuel supply passage, and the nozzle chamber opens to a nozzle outlet. A control valve is mounted in the injector body and is movable between a first position that opens the actuation fluid inlet and closes the actuation fluid drain, and a second position that closes the actuation fluid inlet and opens the actuation fluid drain. An intensifier piston is positioned to reciprocate in the piston bore between an upper position and a lower position. A plunger, having a side surface extending between a contact end and a pressure face end, is positioned to reciprocate in the plunger bore between an advanced position and a retracted position. A portion of the plunger bore and the pressure face end of the plunger define a fuel pressurization chamber that opens to the nozzle chamber. A needle check is positioned to reciprocate in the nozzle chamber between a closed positioned that closes the nozzle outlet and an open position that opens the nozzle outlet. The needle check includes a hydraulic lift surface exposed to the nozzle chamber. This system also includes means, within the injector body, for biasing the needle check toward its closed position.

The plunger has the capability of stopping at a metered positioned between its retracted position and its advanced position, preferably by closing the actuation fluid drain to hydraulically halt further retraction of the plunger/piston. A first supply passage connects the actuation fluid inlet to the source of high pressure actuation fluid. A second supply passage connects the fuel supply passage to the source of fuel fluid. A drain return passage connects the actuation fluid drain to the low pressure actuation fluid reservoir. A control valve is positioned in the injector body and has the ability to move between a first position in which the actuation fluid inlet is open and the actuation fluid drain is closed, and a second position in which the actuation fluid inlet is closed and the actuation fluid drain is open. Finally, the system includes a computer in communication with, and capable of controlling, the position of the control valve.

BEST MODE FOR CARRYING OUT THE INVENTION

Figure 1:
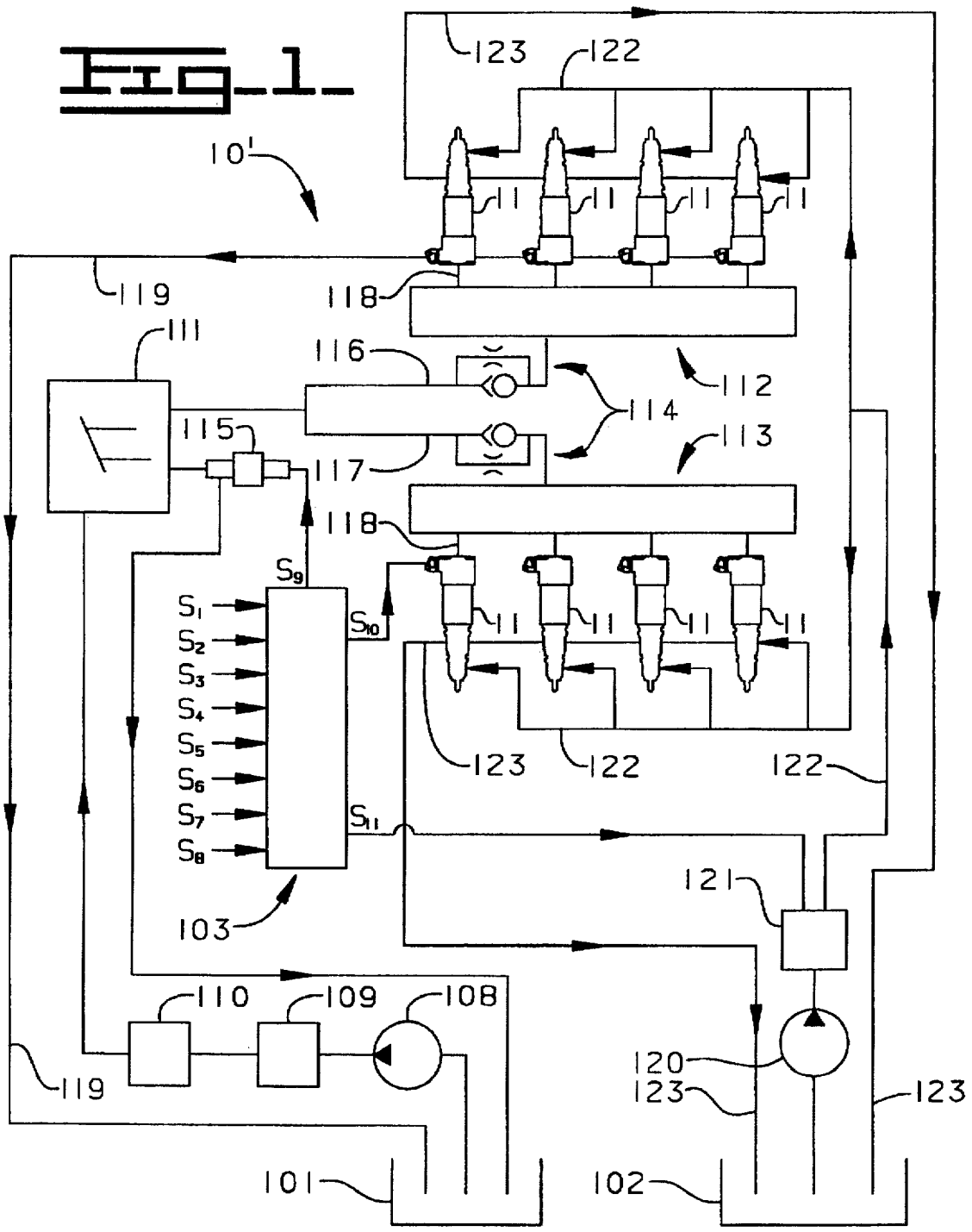
FIG. 1 is a schematic of a fuel injection system according to one embodiment of the present invention.
Figure 2:
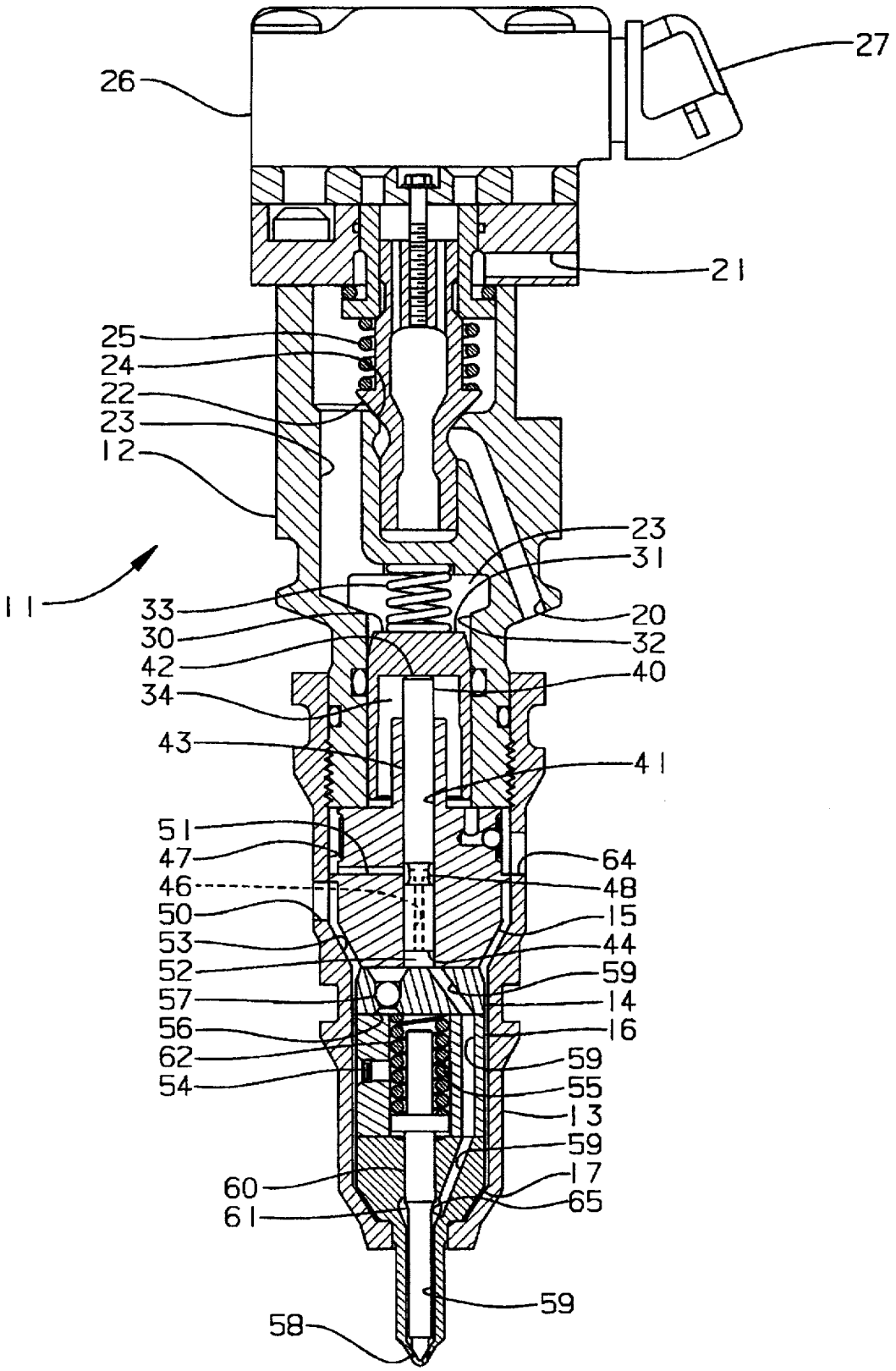
FIG. 2 is a side sectioned elevational view of a fill metered hydraulically actuated fuel injector according to one embodiment of the present invention.

Referring now to FIGS. 1 and 2, the various components of the injection system and each unit injector for one embodiment of the present invention are illustrated. The present invention utilizes two separate fluids in its operation; an actuation fluid, such as lubricating oil, is preferably used as the actuation fluid while fuel, such as ordinary diesel fuel, is utilized as the injection medium. Fuel injection system 10 is schematically illustrated using eight fuel injectors 11 in relation to an example eight cylinder diesel engine (not shown). When in operation, a transfer pump 108 draws actuation fluid (lubricating oil) from oil tank 101, through actuation fluid cooler 109 and actuation fluid filter 110. The pressure of the oil is raised by high pressure pump 111, which pumps it into manifold supply pipes 116 and 117, past Helmholtz resonance controlling means 114 and into actuation fluid manifolds 112 and 113. The actuation fluid inlet 20 (FIG. 2) of each injector 11 is connected to one of the actuation fluid manifolds 112 or 113 via a branch passage 118.

A drain return pipe 119 is connected to the actuation fluid drain 21 (FIG. 2) of each injector 11 and serves as the means by which lubricating oil is returned to oil tank 101, which serves as a low pressure actuation fluid reservoir. In order to avoid unnecessary confusion by including too many fluid lines, no actuation fluid drain pipe is shown in relation to the injectors 11 connected to actuation fluid manifold 113. The pressure within actuation fluid manifolds 112 and 113 is dependent on the output pressure of high pressure pump 111, which is controlled by pressure regulator 115. Regulator 115 is itself is controlled via a signal $S_9$ periodically received from computer 103 that receives a plurality inputs $S_1$–$S_8$ corresponding to vehicle and engine operating conditions in a manner known in the art. The pressure in actuation fluid manifolds 112 and 113 is controlled by the amount of actuation fluid that pressure regulator 115 allows to return to oil tank 101.

The flow of high pressure actuating oil into each injector 11 is also controlled by computer 103 via a different control signal $S_{10}$ that communicates with the solenoid 26 (FIG. 2) of each injector. Again, for the sake of clarity, only one injector is shown connected to computer 103 to receive control signal $S_{10}$. In an operable system, computer 103 communicates with and independently controls the solenoid 26 of each injector 11. The solenoid 26 of each unit injector 11 controls the initiation of each injection event by controlling the control valve 22 that is actuated by the solenoid.

Fuel is circulated from a fuel tank 102 to each unit injector 11 by a fuel transfer pump 120. A fuel pressure regulator 121 ensures that the fuel being supplied to each unit injector is a known value, thus ensuring that the injection system performs as predicted by testing and modeling. An individual branch passage connects the fuel supply opening 50 (FIG. 2) of each injector with the fuel supply pipe 122. Likewise, a separate branch passage (not shown) connects the fuel drain 64 (FIG. 2) of each injector 11 to the fuel return pipe 123. Fuel returned to tank 102 via fuel return pipe 123 is then recirculated for use by injectors 11 at a later time. Thus, in this embodiment, the fuel supply passage 50 and fuel drain passage 64 of each unit injector 11 are isolated from one another. When in operation, only small amounts of fuel are returned to fuel tank 102 via fuel return pipes 123 since only small amounts of residual fuel at the end of each injection event are available to the fuel return passages. Those skilled in the art will appreciate that both the fuel supplies and fuel drains for the injectors 11 can be connected to respective common fuel supply and fuel drain rails.

Since the fuel supply inlet 50 of all of the injectors 11 are open to fuel supply passage 122, all injectors see the same fuel pressure as regulated by fuel pressure regulator 121. Fuel pressure regulator 121 is controlled by computer 103 via a pressure regulation signal $S_{11}$, which controls the magnitude of the fuel supply pressure. This aspect of this embodiment is especially important for controlling the duration of the metering mode of each unit injector. For instance, during cold starts when the actuation fluid lubricating oil is highly viscous, a higher fuel supply pressure is necessary to accomplish the metering mode of the injector in time for the next injection event. The pressure of the fuel supply can be referred to in this embodiment as a medium pressure between the low pressure of the actuation fluid drain passage 119 and the high pressure of the actuation fluid inlet 20.

Referring now to FIG. 2, each unit injector 11 includes an injector body made up of an upper body portion 12, a lower body portion 13, and a series of inner block portions 14–17. Injector body 12–17 includes an actuation fluid cavity 23 that opens to an actuation fluid inlet 20, an actuation fluid drain 21, and a piston bore 32. The injector body also includes a plunger bore 41 that opens to a nozzle supply bore 59 and a fuel supply passage 56. Also included in the injector body is a nozzle chamber 65 that opens to nozzle supply passage 59 and a nozzle outlet 58. A control poppet valve 22 is attached within the injector body and is moveable by solenoid 26 between a first position that opens the actuation fluid inlet 20 and a second position as shown that closes actuation fluid inlet 20. When poppet control valve 22 is in its closed position as shown, actuation fluid cavity 23 is open to actuation fluid drain 21 which is connected via a drain return pipe 119 (FIG. 1) to oil tank 101. When poppet control valve 22 is in it open position, actuation fluid drain 21 is closed. Thus, poppet control valve 22 alternatively and simultaneously opens actuation fluid inlet 20 and closes actuation fluid drain 21, or vice versa.

When solenoid 26 receives its actuation signal (electric current to solenoid 26) $S_{10}$ via connection point 27, popper valve 22 is lifted off of seat 24 against the action of control valve return spring 25. This allows high pressure actuation fluid to flow through inlet 20 into actuation fluid cavity 23. At the same time, actuation fluid drain 21 is closed by popper valve 22 when it reaches its upper stop. When solenoid 26 is deactivated, valve return spring 25 moves poppet valve 22 back to its seat 24 to close actuation fluid inlet 20. Each injection event is initiated by activating solenoid 26.

An intensifier piston 30 is positioned to reciprocate within piston bore 32 between a lower position as shown and an upper position. As is known in the art, intensifier piston 30 acts under the force of actuation fluid pressure within actuation fluid cavity 23 and serves as a means by which that pressure has a multiplying effect in increasing the downward force on contact end 42 of plunger 40. Although not necessary to the invention (proper hydraulic balancing could also prevent the intensifier piston from sealing), a compression spring 33 can be included in order to bias intensifier piston 30 away from its upper position. Spring 33 is preferably chosen to have a spring constant that does not permit actuation of the fuel injector to inject fuel out of nozzle 58, even when fully compressed. The preferred functioning of compression spring 33 will be discussed infra in relation to the fill metering mode of the injector 11. Although intensifier piston 30 includes a lower area exposed to cavity 34, the piston includes only a single hydraulic actuation surface 31 which is exposed to actuation fluid cavity 23. In other words, the vapor pressure within volume 34 is negligible compared to the forces acting on intensifier piston by plunger 40, spring 33 and the pressure within actuation fluid cavity 23. The intensifier pistons of the prior art mentioned earlier each include at least two hydraulic actuation surfaces due to the use of fuel as both an actuation and injection medium.

A plunger 40, having a side surface 43 extending between a contact end 42 and a pressure face end 44, is capable of reciprocating within plunger bore 41 between an advanced position as shown and a retracted position. Contact end 42 of plunger 40 is intended to remain in contact at all times with the underside of intensifier piston 30, and thus for purposes of this embodiment, piston 30 and plunger 40 could be machined from a single part. One possible modification to the present invention could be to include a spring between plunger 40 and intensifier piston 30 in order to delay their relative motion for some desired purpose, such as rate shaping, etc. Plunger 40 also includes a pressure relief passage 46 that opens on one end through pressure face 44 and opens on its other end through side surface 43 via annulus 48. Although not necessary, this aspect of the invention is desired because of its ability to provide an abrupt end to injection by permitting residual fuel pressure at the end of each injection event to be quickly dissipated by exposure to the low pressure within fuel drain passage 64 via fuel return passage 51. Pressure face end 44 of plunger 40 and a portion of plunger bore 41 define a fuel pressurization chamber 52 that opens to nozzle supply bore 59 and a fuel supply passage 56. Thus, the fuel pressurization chamber is in fluid communication with the nozzle chamber. A check valve 57 in fuel supply passage 56 prevents fuel from flowing backward into fuel supply passage 56 from fuel pressurization chamber 52.

A needle check 60 is positioned to reciprocate in nozzle chamber 65 between a closed position, as shown, that closes nozzle outlet 58 and an open position that opens the nozzle outlet. Needle check 60 includes a hydraulic lift surface 61 exposed to the fuel pressure within nozzle chamber 65. A check return spring 62 serves as the means by which needle check 60 is biased toward its closed position. Needle check 60 opens nozzle outlet 58 during each injection event when fuel pressure within nozzle chamber 65 acting on hydraulic surface 61 is sufficient to overcome check return spring 62.

As stated earlier, fuel enters injector 11 at fuel inlet 50. The fuel then flows down through fuel supply passage 53 through filters 54 (either screen or edge filters are preferred) through the chamber holding check return spring 62, up into fuel supply passage 56, past check 57 and eventually into fuel pressurization chamber 52. Check valve 57 prevents reverse flow of fuel.

Figures 3, 4, 5, 6:
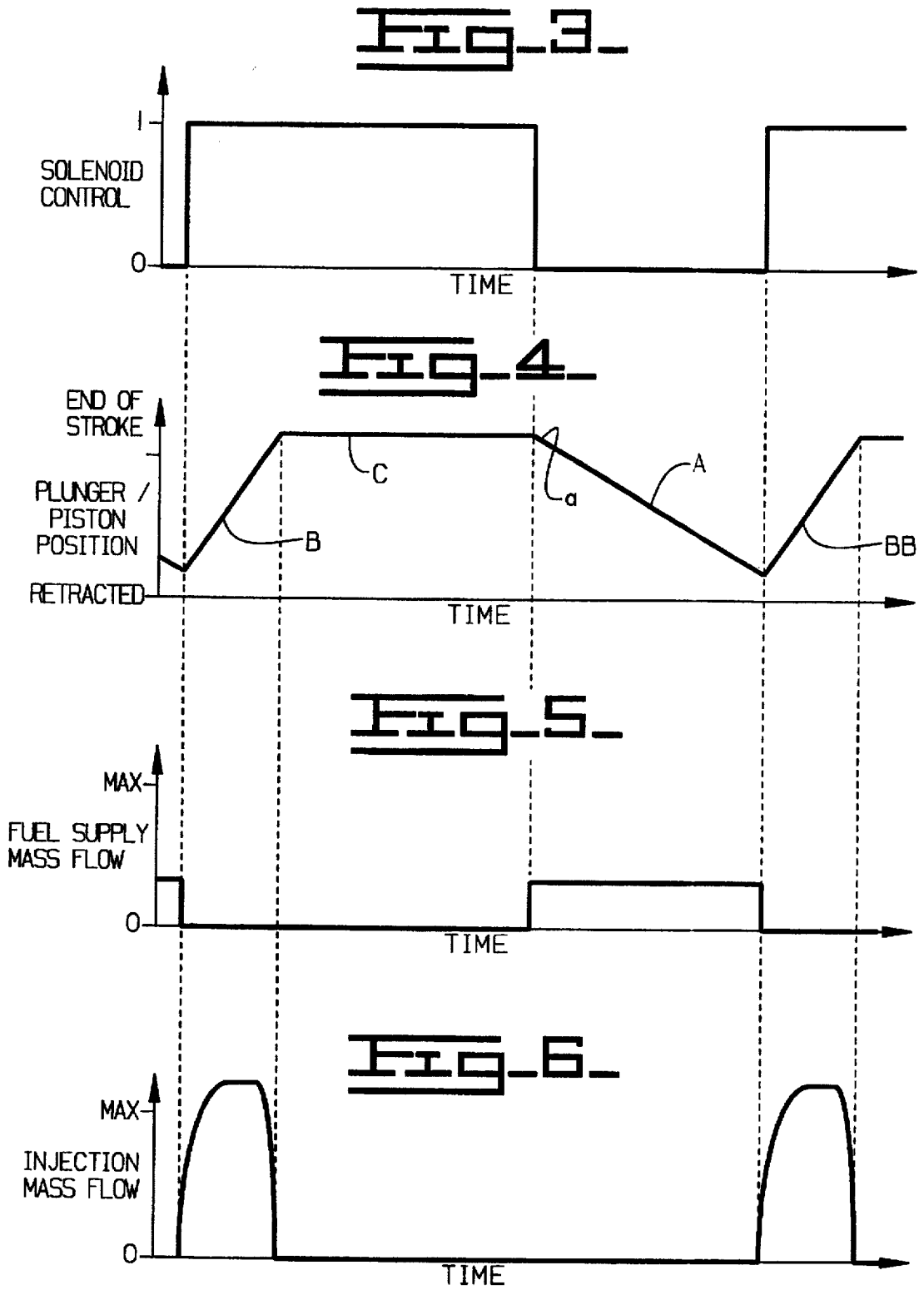
FIG. 3 shows control valve signal versus time for an example injector cycle relating to the injection system and injector shown in FIGS. 1 and 2, respectively.
FIG. 4 is a graph of plunger/piston position versus time for injector cycle example of FIG. 3.
FIG. 5 is a graph of fuel supply mass flow versus time for the example injector cycle of FIGS. 3 and 4.
FIG. 6 is a graph of injection mass flow versus time for the example injector cycle of FIGS. 3–5.
Figure 7:
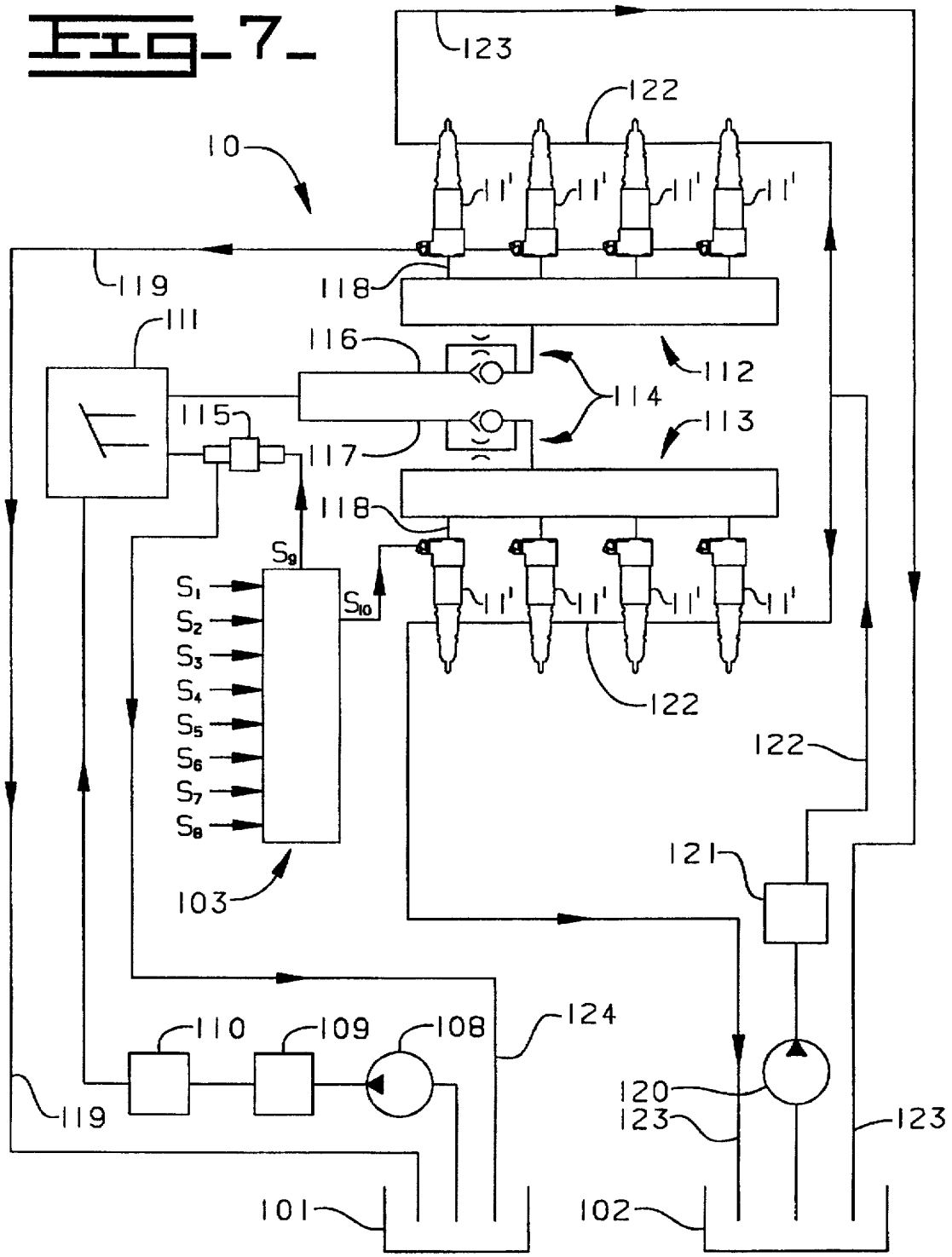
FIG. 7 is a schematic view of a fuel injection system according to another embodiment of the present invention.
Figure 8:
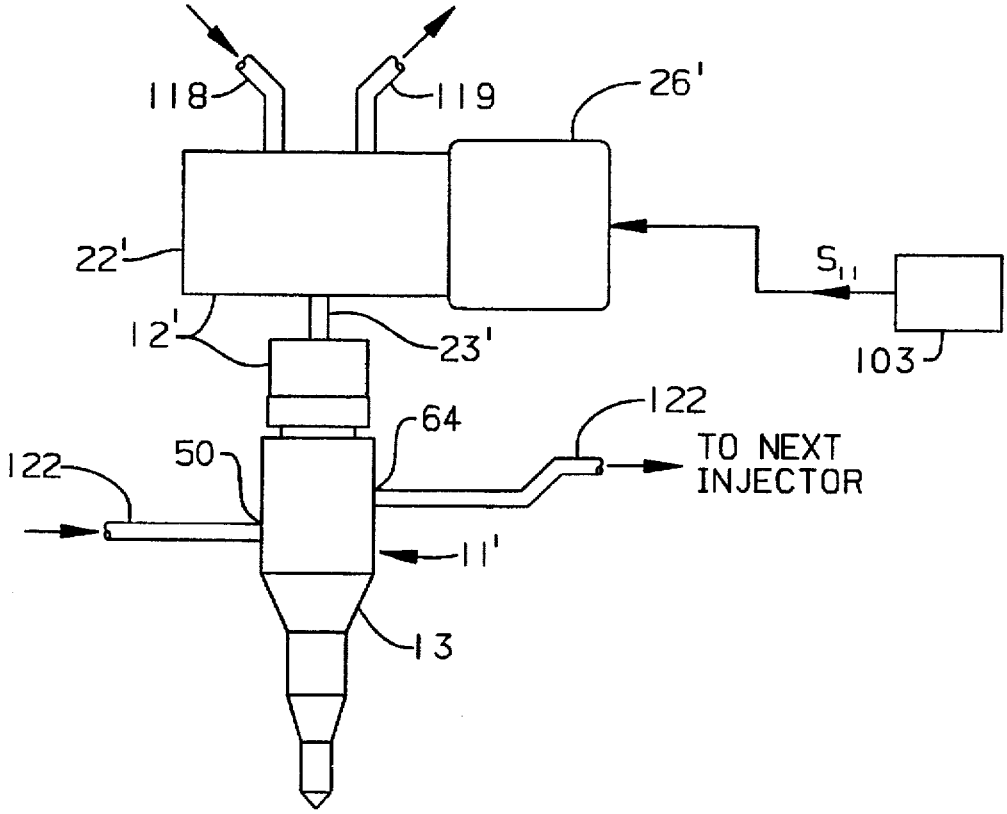
FIG. 8 is a side elevational view of a portion of the fuel injection system shown in FIG. 7.

Referring also now to FIGS. 3–6, injector 11 is shown at about point (a) on FIG. 4 just as the injector is beginning its metering mode (A). At this time, control valve 22 has closed high pressure actuation fluid inlet 20 and opened actuation fluid drain 21 to actuation fluid cavity 23. The actuation fluid drain pressure is chosen to be low enough to allow the fuel supply pressure acting on pressure face end 44 of plunger 40 to overcome the downward force acting on intensifier piston 30 by the actuation fluid drain pressure in actuation fluid cavity 23 and the downward force of compression spring 33.

In this way, fuel pressure begins to flow through fuel supply passages 53 and 56 into fuel pressurization chamber 52 hydraulically pushing plunger and piston to move toward their retracted positions. Intensifier piston 30 and plunger 40 continue in their movement toward their retracted position until the desired amount of fuel has been metered into fuel pressurization chamber 52. The metering rate of fuel into the injector is controllable by controlling the respective forces acting on intensifier piston 30 via actuation fluid drain pressure and the fuel pressure acting on pressure face 44 of plunger 40. This is another reason why it is desirable to keep piston 30 in contact with plunger 40 in order to aid in making the metering mode more precise and predictable. In this embodiment, the fuel metering rate into the injector is controlled by regulating the fuel supply pressure via control signal S11 which is sent by computer 103 to fuel pressure regulator 121 (see FIG. 1). The metering rate could alternatively be controlled by regulating fluid pressure in the actuation fluid drain 21 and maintaining fuel supply pressure at a known value. In the event that the fuel drain pressure at fuel drain 64 is lower than the regulated fuel supply pressure, it will be necessary to use a gasket or some other means to isolate the fuel supply inlet 50 from direct communication with fuel drain 64 in each injector 11.

The metering mode (A) is ended when plunger 40 has stopped and its direction of travel reversed by the activation of solenoid 26 to initiate a subsequent injection event (area BB of FIG. 4). When solenoid 26 is activated, poppet valve 22 lifts off of seat 24 and simultaneously opens high pressure actuation fluid inlet 20 and closes actuation fluid drain 21. Thus, high pressure actuation fluid flows into actuation fluid cavity 23 causing intensifier piston 30 to begin its movement downward toward its lower position. The downward movement of intensifier piston 30 causes plunger 40 to move downward so that the fuel within fuel pressurization chamber 52 is compressed. It should be noted that at this point in its operation, pressure relief passage 46 in plunger 40 is closed. Eventually, fuel pressure within fuel pressurization chamber 52 rises significantly enough that the upward hydraulic forces acting on needle check 60 are sufficient to open nozzle 58, allowing the injection of fuel to commence. Each injection event is abruptly ended when pressure relief passage 46 opens to fuel return passage 51 when plunger 40 has reached the end of its stroke. This allows needle check 60 to move quickly to its closed position to provide an abrupt ending to each injection event because of two reasons: (1) needle check 60 closes more rapidly because the residual upward hydraulic force acting on the check is dissipated very quickly; and (2) the residual fuel pressure in nozzle chamber 65 is so low that only small amounts of fuel leave nozzle outlet 58 while needle check 60 is moving toward its closed position. Those skilled in the art will appreciate that pressure relief passage 46 in plunger 40 is preferable in order to provide a more abrupt end to injection but not required to the proper functioning of the present invention.

At this point in its operation, poppet control valve 22 is still open in the area (C) shown in FIG. 4 but intensifier piston 30 and plunger 40 have reached the end of their stroke. Poppet control valve 22 is maintained open by solenoid 26 until the time period for the metering mode corresponds to the amount of time until the next injection event. Thus, in this embodiment, the timing of the metering mode and each injection event are coupled since the end of metering mode (A) corresponds to the beginning of a subsequent injection event (BB), which is initiated by actuating solenoid 26. FIGS. 3–6 show an example mode of operation for fuel injector 11. In each injection cycle, the standby time period (C) can typically be significantly longer than that shown in the example. For instance, at relatively low engine speeds when the time between each injection event is long, the standby period (C) can be many times longer than the metering mode (A) and the injection mode (B or BB) combined.

Referring now to FIGS. 7–13, a second embodiment of a fuel injection system 10' is illustrated in the same manner as the previous embodiment. System 10' differs from the previous system in that there is no need in this embodiment for fuel pressure regulator 121 to be computer controlled and there is no need in this embodiment to isolate the fuel supply for each injector from its fuel drain, as in the previous embodiment. In this embodiment, the control valve for each injector 11' is a three-way solenoid controlled spool valve rather than the two-way poppet valve of the previous embodiment. As will be discussed infra, this structure permits the fuel supply and fuel drains of each set of injectors to be connected in series so that fuel is circulated to and through the injectors at a constant known pressure. The three-way control valve 22' of each injector 11' has the ability to independently control the metering mode and injection modes for each injector 11'. Recalling that in the previous embodiment the metering and injection modes of the injectors were coupled since the end of each metering mode corresponded to the start of each injection mode. Other than the differences just described, the various components of fuel injection system 10' are substantially identical to the earlier embodiment, and a description of those components will not be repeated here.

Fuel supply passage 122 is connected to the fuel supply opening 50 (FIG. 2) of the first injector in each series. A subsequent portion of fuel supply pipe 122 interconnects the fuel drain 64 (FIG. 2) to the fuel supply inlet 50 of the subsequent injector. Since fuel is allowed to freely circulate through each unit injector between fuel supply inlet 50 and fuel drain 64, all injectors see the same fuel pressure as regulated by fuel pressure regulator 121. It should be understood that each injector could also be modified to be supplied with fuel from a common rail, and each injector could also drain individually into a second common rail. Such a modification would sometimes be desirable (as in the previous embodiment shown in FIGS. 1–6) where it is desired to isolate the fuel supply from the fuel drain within each unit injector. In the present embodiment a fuel return pipe or passage 123 leads from the fuel drain 64 of the final injector in each series in order to recirculate fuel to fuel tank 102.

Each injector 11' is substantially identical in structure to the injectors 11 of the earlier embodiment except that a three-way spool valve 22' has been substituted for the two-way popper valve 22 of the previous embodiment. In other words, injector 11' includes internal structure substantially identical to injector 11 from compression spring 33 down to and including nozzle 58. Therefore, a detailed description of these components will not be repeated here. Thus reference can be made to the internal structure of previous injector 11 in FIG. 2 as a reference to view the internal structure of injector 11' of the present embodiment. Like the earlier embodiment, a high pressure actuation fluid supply pipe or passage 118 is attached to three-way control valve 22' and opens to a passageway 87. An actuation fluid drain pipe or passage 119 is also connected to three-way valve 22' and opens to passage 88. A third passage 89 within three-way valve 22' opens to an actuation fluid cavity passage 23' which is in fluid contact with the hydraulic actuation surface 31 (FIG. 2) of intensifier piston 30 (FIG.

Figure 9:
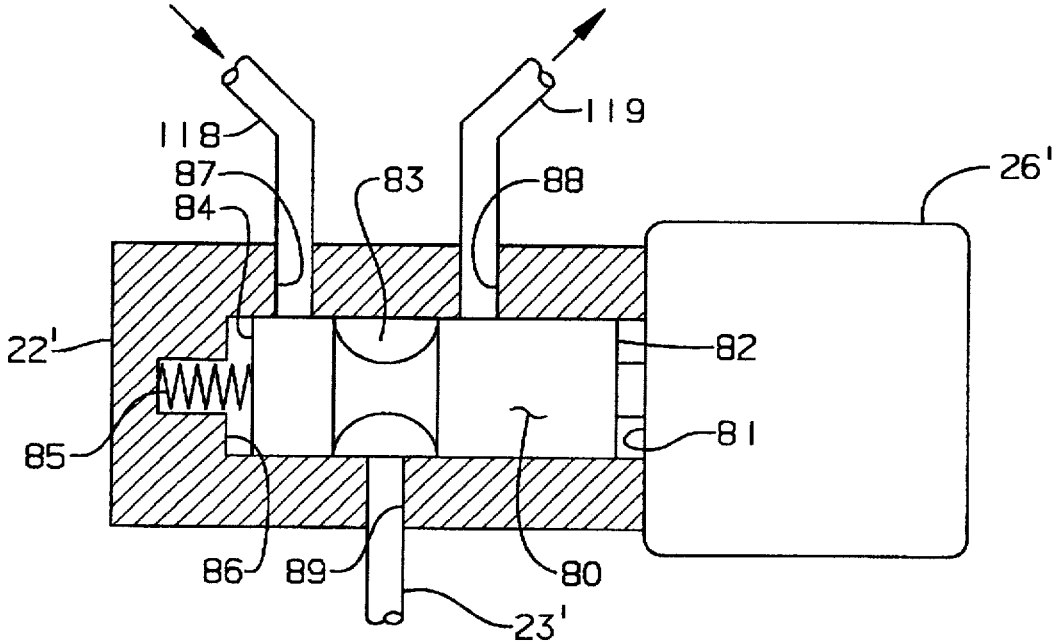
FIG. 9 is a partially sectioned side elevational view of the three-way control valve utilized in the fuel injection system and injector shown in FIG. 7 and 8, respectively.

2). A spool 80 includes an annulus portion defining a cavity 83, and includes a first end 84 acted on by a compression spring 85 and a second end 82 acted upon by an electronic solenoid 26'. Spool 80 in FIG. 9 is shown in its middle position such that actuation fluid cavity passage 23' is closed to both the high pressure actuation fluid supply 118 and the low pressure actuation fluid drain 119. This position of three-way valve 22' is accomplished by partially energizing solenoid 26' in a manner known in the art.

Figure 10:
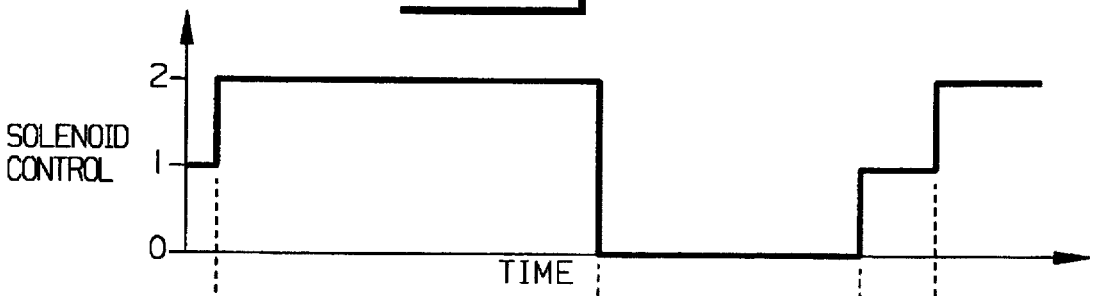
FIG. 10 is a graph of control valve signal versus time for an example injector cycle utilizing the injector and system shown in FIGS. 7–9.

When it is desired to initiate an injection event, computer 103 sends a full activation signal $S_{11}$ to solenoid 26' which then causes spool 80 to move farther to the left in FIG. 9 so that passage 87 becomes open to passage 89 via annulus cavity 83. When this occurs, high pressure actuation fluid begins to flow into actuation fluid cavity passage 23' to act upon the hydraulic actuation surface 31 of intensifier piston 30 in the manner previously described (see FIG. 2). Since each injection event is terminated by the plunger reaching the end of its stroke, the actual injection event (FIG. 13) is over while solenoid 26' remains fully activated (FIG. 10). Thus in both embodiments of the present invention so far described, full actuation of the solenoid 26 or 26' initiates the injection event, but the end of each injection event corresponds to when the intensifier piston/plunger combination has reached the end of their stroke rather than by deactivating the solenoid as in previous similar hydraulically actuated fuel injectors such as the injection system described in U.S. Pat. No. 5,121,730 to Ausman et al. When solenoid 26' is fully activated, the first end 84 of spool 80 rests against stop 86. If the three-way valve 22' of FIG. 9 were substituted for the two-way poppet valve 22 of FIG. 2, the injector would appear at point (a) on FIG. 11, with the solenoid 26' having just been deactivated and spool 80 moving toward the draining position in which end 82 abuts stop 81 under the action of compression spring 85. In this position, the high pressure within actuation fluid cavity passage 23' is vented to the low pressure in actuation fluid drain 119 via passage 89 annulus cavity 83 and passage 88 within three-way valve 22'. When the spool 80 reaches this position, the metering mode (A) of the injector commences (FIG. 11).

After the desired amount of fuel has been metered into fuel pressurization chamber 52 of the injector, solenoid 26' is partially activated to return to the medium position that closes both the actuation fluid supply 118 and the actuation fluid drain 119. Because no more fluid can evacuate from actuation fluid cavity passage 23', the upward retracting movement of both plunger 40 and intensifier piston 30 are stopped, and the injector enters a preinjection standby mode (D) FIG. 11). During preinjection standby mode (D), solenoid 26' is partially activated and the injector ms prepared for the next injection event (BB), which will commence by activating solenoid 26' to its fully activated position.

Figure 11:
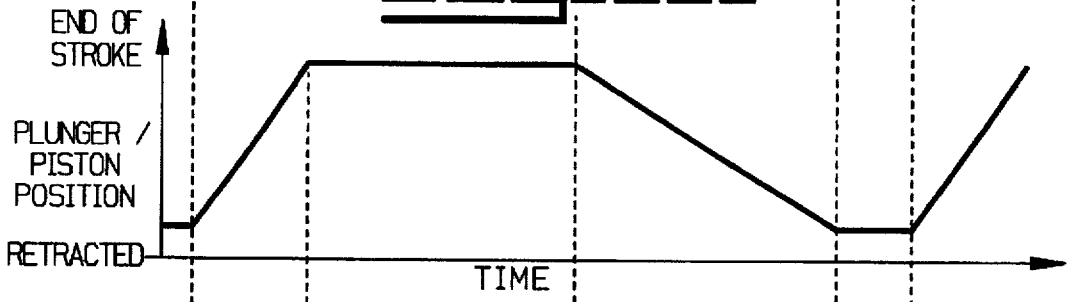
FIG. 11 is a graph of plunger/piston position versus time for the injector cycle example of FIG. 10.
Figure 12:
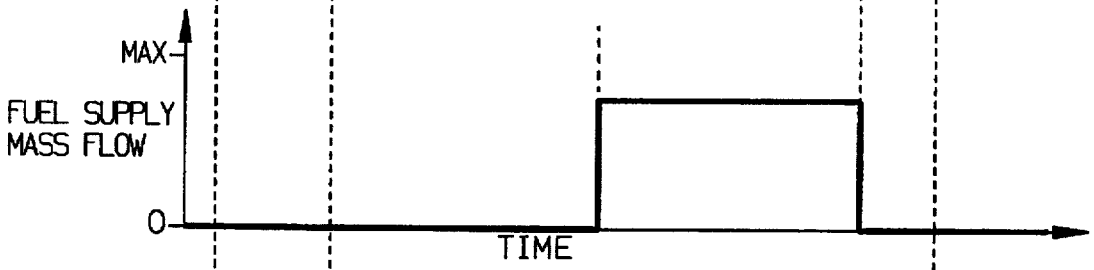
FIG. 12 is a graph of fuel supply mass flow versus time for the example injector cycle example of FIGS. 10–11.
Figure 13:
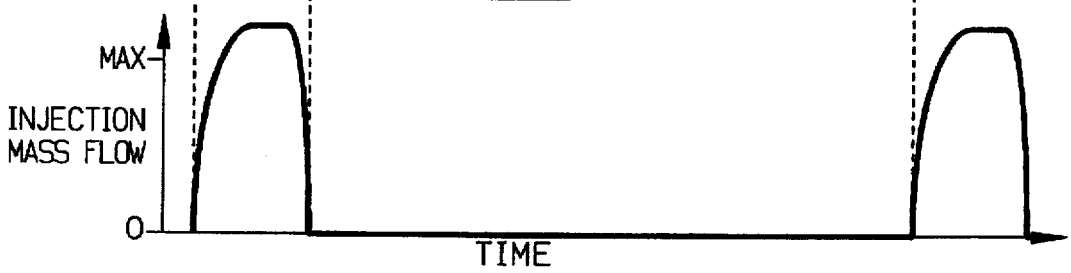
FIG. 13 is a graph of injection mass flow versus time for the injector cycle example of FIGS. 10–12.

FIGS. 10–13 show an example injector profile. As best seen in FIG. 11, the three-way action of valve 22' allows the metering mode (A) and the injection mode (B) or (BB) to be de-coupled because the retracting movement of the piston/plunger is stopped and remains stopped before the initiation of the next injection event during pre-injection standby mode (D). In addition to this de-coupling, fuel injection system 10' of FIG. 7 also allows the fuel supplies 50 and fuel drains 64 of injectors 11' to be connected in series because there is no need to isolate fuel supply from the fuel drain in this embodiment. However, in those embodiments where it is desirable to regulate fuel supply pressure, it may be necessary to isolate fuel supply 50 from fuel drain 64 as in the previous embodiment. As discussed earlier, the ability to regulate fuel supply pressure gives one the ability to control the duration of each metering mode (A). In other words, higher pressure fuel supply shortens the metering duration relative to a lower pressure fuel supply because the hydraulic forces acting on plunger 40 is proportional to the pressure of the fuel supply.

Figure 14:
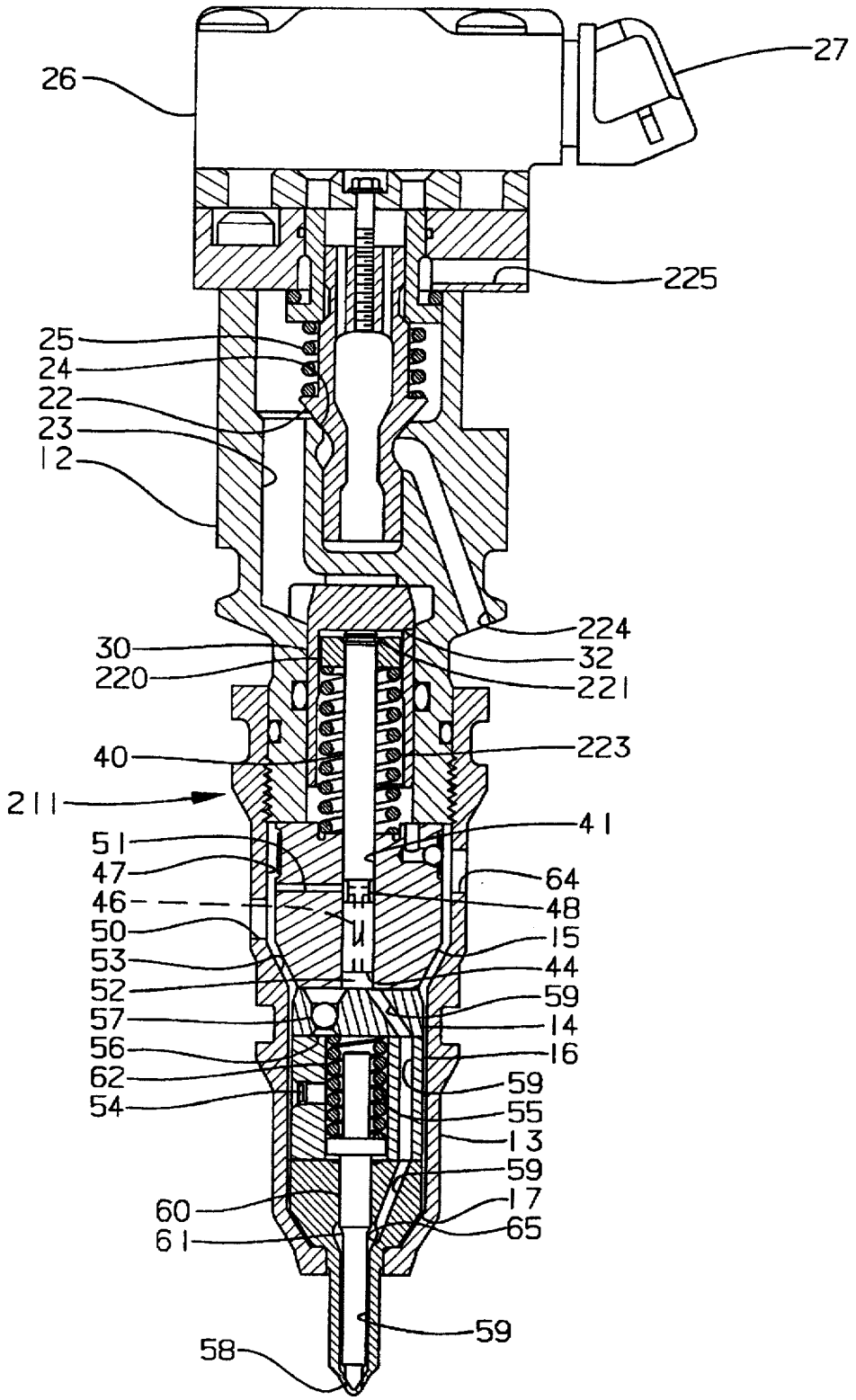
FIG. 14 is a side sectioned elevational view of a fill metered hydraulically actuated fuel injector according to still another embodiment of the present invention.

In both of the injector system embodiments described in relation to FIGS. 1–13, pressurized fuel is utilized to hydraulically push the plunger to retract during the metering mode. While this feature of the previous embodiments allows one to control the duration of the metering mode by controlling the magnitude of the fuel pressure, control of this aspect of the invention is not always desirable because of the increased complexity of the fuel pressure regulating subsystem. Referring now to FIG. 14, an injector 211 according to still another embodiment of the present invention is shown. Injector 211 is substantially similar in structure to the earlier injector 11 illustrated in FIG. 2 except this embodiment utilizes a return spring 223 as the means by which plunger 40 and piston 30 are retracted during the metering mode. This embodiment also differs from the earlier embodiment in that there is no need to isolate fuel supply opening 50 from fuel drain opening 64 because the pressure of the fuel entering and exiting each unit injector is not controlled or otherwise regulated. The final difference between the injector 211 of FIG. 14 and injector 11 of FIG. 2 is that in this embodiment the actuation fluid inlet and actuation fluid drains are reversed. All other features of injector 211 are substantially similar to the earlier embodiment and identical numbers are utilized to identify same. Therefore, the reader is referred back to the description with regard to the various features that were previously described. It is also important to note that, when in operation, injector 211 will present profiles substantially identical to FIGS. 4, 5 and 6; however, a graph of solenoid control (FIG. 3) of the injector for injector 211 would be different because of the reverse of the actuation fluid inlet and the actuation fluid drains for the injector. In other words, the solenoid of injector 211 is de-energized during injection rather than being energized during injection as in the previous embodiment.

In injector 211, the passage 225 serves as the actuation fluid inlet and passage 224 serves as an actuation fluid drain. By reversing the functioning of these two ports in the present embodiment, the logic relating to control valve 24 is also reversed. Recalling that in the previous embodiment, solenoid 26 was activated in order to open the actuation fluid inlet and simultaneously close the actuation fluid drain. In this embodiment, the logic is reversed. Deactivation of control valve 24 opens actuation fluid inlet 225 and closes actuation fluid drain 224. This aspect of this embodiment is important in relation to injector heat dissipation and the power demands and distribution of power to the various solenoids in a complete fuel injection system having multiple injectors, such as 8 for an 8 cylinder engine.

Figure 15:
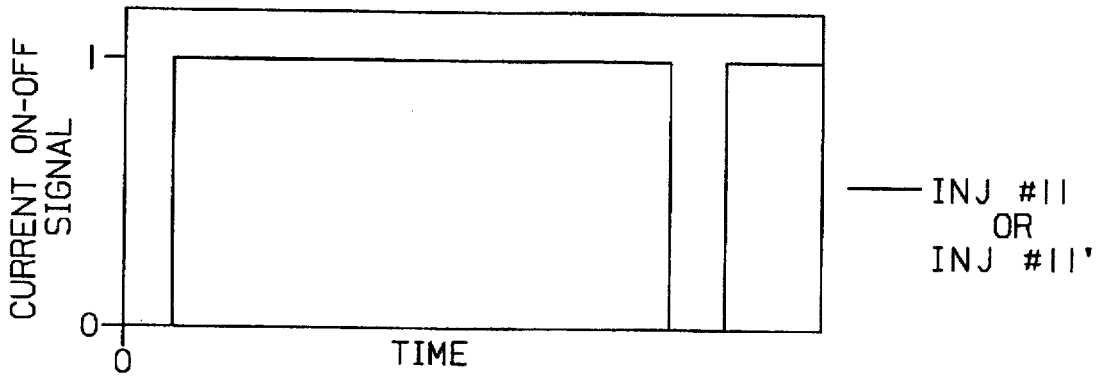
FIG. 15 is a graph of current demand versus time for an injector according to the embodiment shown in FIGS. 1–6.
Figure 16:
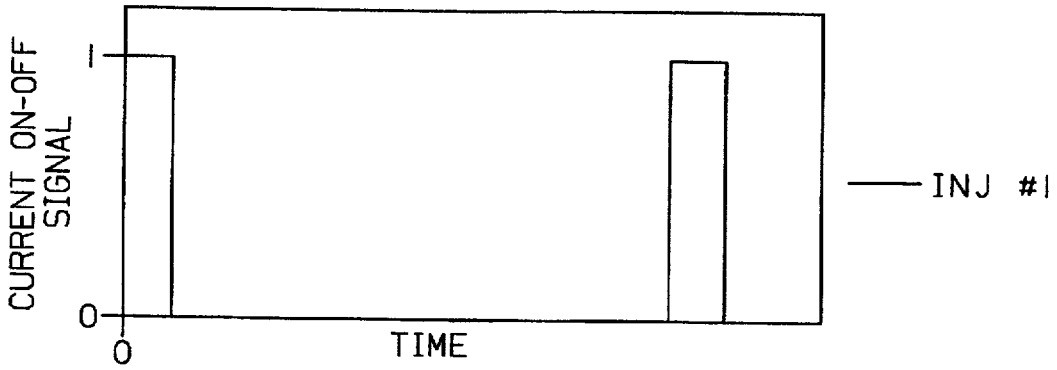
FIG. 16 is a graph of current demand versus time for a fuel injector according to the embodiment shown in FIG. 14.
Figure 17:
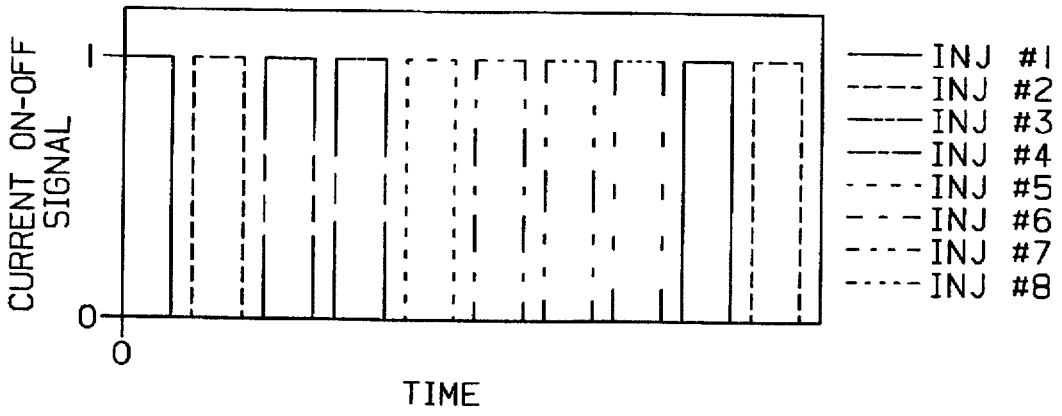
FIG. 17 is a graph of current demand versus time for a fuel injection system according to the present invention utilizing injectors of the type shown in FIG. 14.

FIGS. 15–17 will be useful in explaining the advantages gained by reversing the actuation fluid inlet and drain as well as the control logic of control valve 24. FIG. 15 shows the solenoid control signal for a typical injector cycle in relation to the non-reversed injector illustrated in FIG. 2. Each injector cycle includes a metering mode (A), an injection mode (B) and a standby mode (C). In most cases the longest portion of each injector cycle will be made up of the pre-metering standby mode (see portion C of FIG. 4). During this complete time period, the solenoid is activated in order to maintain the actuation fluid inlet open and the actuation fluid drain closed. Because the solenoid of each injector must be activated for the majority of time of each injector cycle, one can immediately appreciate that as a direct consequence, several or most of the injectors in a complete injection system will be in an activated mode simultaneously. Thus, in the previous embodiment of FIGS. 1 and 2, the power supply to the solenoids of the various injectors must have the ability to simultaneously provide power to several or most of the injectors simultaneously. In the reversed logic injector 211 of FIG. 14 on the other hand, each individual injector consumes less power and therefore must dissipate less heat.

FIG. 16 shows a typical solenoid current control signal for an injector of the type shown in FIG. 14 having the actuation fluid inlet and drain reversed. By reversing the actuation fluid drain and actuation fluid inlet, the solenoid for the particular injector need only be activated during the relatively brief metering mode portion of each injector cycle. This allows heat within the injector due to solenoid energization more time to dissipate relative to that of the earlier embodiment. Thus, with the reverse strategy, the solenoid for each injector remains deactivated during the standby mode between each injection event and the metering mode of each injector cycle. Because the standby mode is oftentimes longer than the injection mode and the metering mode durations combined, a considerable amount of energy is saved with the reversed strategy of the injector shown in FIG. 14. In fact, and as illustrated in FIG. 17, the reversed logic allows for the possibility of 10 energizing the solenoid of each injector sequentially and at different times so that no two injectors need be activated simultaneously. Thus, the power supply to the various solenoids 26 of the unit injectors need only have the capability of supplying power to activate a single solenoid at any given time. Those skilled in the art will appreciate that the non-reversed strategy illustrated in FIG. 15 could require as many as 7 out of 8 unit injectors to be simultaneously activated if 8 injectors of the type shown in FIG. 15 were projected into a graph of a type shown in FIG. 17.

Referring back to FIG. 14, return spring 223 is chosen to have sufficient strength to not only move plunger 40 and piston 30 to retract during the metering mode against the actuation fluid drain pressure existing in actuation fluid cavity 23, but also should have the ability to draw fuel into fuel pressurization chamber 52. Again, in this embodiment, fuel need only be circulated to the various injectors at a relatively low pressure because it is not required to do any work in moving the plunger and piston to retract as in the earlier embodiments.

The other minor differences in structure between the injector shown in FIG. 14 and that of the injector shown in FIG. 2 is the inclusion of a washer 220 and a ring 221 attached to plunger 40. This assembly allows plunger 40 and piston 30 to move in unison under the action of return spring 223. As stated earlier, the injector of FIG. 14 operates substantially identical to the embodiments shown in FIG. 2 except for the reversed logic of the control valve and the means by which the plunger and piston are retracted. In other words, the performance profiles shown in FIGS. 4–6 for the FIG. 2 embodiment would be identical for the FIG. 14 embodiment.

In still another embodiment of the present invention, one might consider substituting the three-way spool valve of FIG. 9 into the injector of FIG. 14 in order to provide the additional standby mode (D) shown in FIG. 11. However, it might also be desirable in such an alternative embodiment to also reverse the actuation fluid inlet and actuation fluid drain so that the control valve is normally biased to maintain the actuation fluid inlet open rather than closed as in the earlier embodiment. This reversing control strategy will also save energy in those cases where a three-way valve is utilized.

Industrial Applicability

The hydraulically actuated fuel injection systems previously described use an actuation and damping fluid which is separate from the fuel used for injection into the engine. The advantages of using engine lubricating oil rather than fuel as a source for the actuation fluid and damping fluid are as follows. Engine lubricating oil has a higher viscosity than fuel and therefore the high pressure actuation fluid pump 111 and the body assembly 12–17 of each unit injector 11, 11' do not require the degree of precision clearances or additional pumping capacity that would be required in order to pump fuel without excessive leakage particularly when starting an engine when the fuel is still relatively hot. The engine lubricating oil provides better lubrication than does, for example, diesel fuel. Such lubrication is especially needed in the guide and seats of two-way poppet valve 22 and three-way spool valve 22'. The engine lubricating oil is also able to utilize the oil drain passage 119 to the oil tank 101 and transfer pump 108 that normally exist in a conventional engine, whereas fuel used as actuating and damping fluid requires additional passages or external lines for draining that fuel back to the fuel tank, and possibly the addition of fuel cooler since the fuel is continually recirculated and worked. The venting of high pressure actuation fluid into drain pipes 119 which are separate from the fuel supply paths also helps prevent variation in fuel delivery and timing of injection between various unit injectors 11 or 11', and creates a higher potential of oil dilution from leaking fuel passages rather than vice versa.

Because the present invention allows for controlling the duration of each metering mode (A) (FIG. 4 and FIG. 11) by controlling one or either the fuel supply pressure as shown in FIG. 1 and/or the actuation fluid drain pressure (this alternative not shown), at least one embodiment of the present invention is particularly advantageous during cold starting periods for a diesel engine. During cold starting, the lubricating oil is substantially more viscous and the fuel pressure necessary to retract the plunger and piston of the injector must necessarily be increased in order to overcome this viscosity and have the desired amount of fuel metered into the injector before the next injection event. Thus, during cold staring periods, fuel supply pressure is increased and/or the pressure within actuation fluid drain pipe 119 is lowered.

Although the present invention finds applications in a wide variety of injection systems, it is particularly well suited to diesel engines of the type manufactured and sold by Caterpillar, Inc. of Peoria, Ill. In precursor hydraulically actuated electronically controlled injectors to the present injectors, both the initiation and end of each injection event was controlled by the solenoid actuated valve. The present invention, on the other hand relies upon the plunger reaching the end of its stroke to terminate each injection event. This strategy accomplishes a significantly more abrupt ending to each injection event, which in turn results in improved combustion efficiency and lowers the presence of unburned hydrocarbons in the combustion exhaust. When the preferred embodiment of the present invention is utilized such that plunger 40 includes a pressure relief passage 46, each injection event ends even more abruptly because the pressure holding the needle check open is quickly relieved allowing the check to close faster. In addition to providing an abrupt end to injection, the strategy of the present invention may also prolong the life of the injector by allowing vibrations and pressure waves to dissipate before the metering mode A of each injector begins. Finally, the three-way valve option of the present invention described in FIGS. 7–13 permits the inclusion of a pre-injection standby mode (D) in which the injector has the precise amount of fuel to be injected in the next injection event metered into the injector, and both the intensifier piston and plunger are stopped. In the previous embodiment, the coupling of the metering mode and injection mode require the piston/plunger combination to reverse movement directions between the metering mode (A) and injection mode (B).

Although several embodiments of the present invention having various features have been illustrated, those skilled in the art will appreciate that many known modifications can be made without departing from the teachings and scope of the present invention. In other words, the above description is intended for illustrative purposes only, and the actual scope of the invention is defined solely in terms of the claims as set forth below.

We claim:

1. A hydraulically actuated fuel injector comprising:

an injector body having an actuation fluid cavity that opens to an actuation fluid inlet, an actuation fluid drain and a piston bore, and having a plunger bore that opens to a fuel supply passage and a nozzle chamber, and said nozzle chamber opens to a nozzle outlet;

a control valve mounted in said injector body and being movable between a fixed first position that opens said actuation fluid inlet and closes said actuation fluid drain, and a fixed second position that closes said actuation fluid inlet and opens said actuation fluid drain;

an intensifier piston positioned to reciprocate in said piston bore between an upper position and a lower position;

a plunger having a side surface extending between a contact end and a pressure face end being positioned to reciprocate in said plunger bore between an advanced position and a retracted position;

a portion of said plunger bore and said pressure face of said plunger defining a fuel pressurization chamber that opens to said nozzle chamber;

a check valve positioned in said fuel supply passage and being operable to prevent flow of fuel from said fuel pressurization chamber back into said fuel supply passage;

a needle check positioned to reciprocate in said nozzle chamber between a closed position that closes said nozzle outlet and an open position that opens said nozzle outlet, said needle check including a hydraulic lift surface exposed to said nozzle chamber;

means, within said injector body, for biasing said needle check toward said closed position;

said intensifier piston having a single hydraulic actuation surface, and said hydraulic actuation surface being exposed to said actuation fluid cavity; and means for closing said actuation fluid cavity to said actuation fluid drain to stop said plunger at a metered position between said retracted position and said advanced position when said plunger is retracting from said advanced position.

2. The fuel injector of claim 1 further comprising means, including a spring within said injector body, for biasing said intensifier piston away from said upper position, and said spring having insufficient strength to compress fuel in said fuel pressurization chamber above a valve opening pressure that would overcome said means for biasing said needle check.

3. The fuel injector of claim 1, wherein said injector body includes a fuel return passage that is substantially free of obstructions and opens into said plunger bore;

said plunger includes a pressure relief passage that opens on one end through said pressure face end and opens on its other end through said side surface; and said pressure relief passage opens said fuel pressurization chamber to said fuel return passage when said plunger approaches said advanced position.

4. The fuel injector of claim 1, wherein said actuation fluid inlet is connected to a source of high pressure actuation fluid;

said fuel supply passage is connected to a source of fuel fluid that is different from said actuation fluid; said actuation fluid drain is connected to a low pressure actuation fluid reservoir via a drain return passage that is substantially free of restrictions.

5. The fuel injector of claim 1, wherein said control valve has a fixed third position in which said actuation fluid drain and said actuation fluid inlet are closed.

6. The fuel injector of claim 1, further comprising means, within said injector body, for biasing said plunger toward said retracted position.

7. A method of fuel injection comprising the steps of:

providing a fuel injector having an injector body with an actuation fluid cavity that opens to an actuation fluid inlet, an actuation fluid drain and a piston bore, and having a plunger bore that opens to a nozzle chamber and a fuel supply passage, and said nozzle chamber opens to a nozzle outlet; said injector also having an intensifier piston positioned in said piston bore, a plunger positioned in said plunger bore adjacent said intensifier piston, a needle check positioned in said nozzle chamber and biased to close said nozzle outlet, and a check valve positioned in said fuel supply passage, said check valve permitting flow into said plunger bore but preventing reverse flow;

connecting said actuation fluid inlet to a source of high pressure actuation fluid;

connecting said actuation fluid drain to a low pressure return line;

connecting said fuel supply passage to a source of fuel fluid, which is different from said actuation fluid;

opening said actuation fluid inlet to flow of high pressure actuation fluid to hydraulically push said intensifier piston against said plunger until both are moving together in a forward direction to initiate an injection event;

closing said actuation fluid drain;

closing said actuation fluid inlet to further flow of said high pressure actuation fluid;

opening said actuation fluid drain;

retracting said plunger in a return direction opposite to said forward direction as fuel fluid flows into said injector body; and stopping said plunger when a desired amount of said fuel fluid for a subsequent injection event has flowed into said injector body through said fuel supply passage at least in part by closing said actuation fluid drain.

8. The method of claim 7, wherein said step of stopping said plunger includes a step of:

opening said actuation fluid inlet when said desired amount of said fuel fluid has flowed into said injector body.

9. The method of claim 7, wherein said injector body includes a fuel return passage, and the method further comprising the step of:

opening said nozzle chamber to said fuel return passage after said step of opening said actuation fluid inlet but before said step of retracting said plunger.

10. The method of claim 7, wherein said step of stopping said plunger is accomplished by the step of:

opening said actuation fluid inlet to flow of high pressure actuation fluid to initiate a subsequent injection event; and closing said actuation fluid drain.

11. The method of claim 10, wherein said injector body includes a fuel return passage, and the method further comprising the step of:

opening said nozzle chamber to said fuel return passage after said step of opening said actuation fluid inlet but before said step of retracting said plunger.

12. The method of claim 7, wherein said step of retracting said plunger occurs over a time period, and said time period is controlled by the step of:

regulating the pressure of said fuel fluid.

13. The method of claim 12, wherein said step of closing said actuation fluid inlet is carried out when the time to a subsequent injection event is about equal to said time period.

14. The method of claim 7, wherein said step of retracting said plunger is accomplished by the steps of:

pressurizing said fuel fluid to a pressure greater than the pressure in said actuation fluid drain; and hydraulically pushing said plunger in a retracting direction opposite to said forward direction using said fuel fluid.

15. The method of claim 7, wherein said step of retracting said plunger is accomplished by the step of:

biasing said plunger in a retracting direction opposite to said forward direction.

16. A fuel injection system comprising:

a source of high pressure actuation fluid;

a low pressure actuation fluid reservoir;

a source of fuel fluid different from said actuation fluid;

a hydraulically actuated fuel injector comprising: an injector body having an actuation fluid cavity that opens to an actuation fluid inlet, an actuation fluid drain and a piston bore, and having a plunger bore that opens to a nozzle chamber and a fuel supply passage, and said nozzle chamber opens to a nozzle outlet;

an intensifier piston positioned to reciprocate in said piston bore between an upper position and a lower position;

a plunger having a side surface extending between a contact end and a pressure face end, and being positioned to reciprocate in said plunger bore between and advanced position and a retracted position;

a portion of said plunger bore and said pressure face end of said plunger defining a fuel pressurization chamber that opens to said nozzle chamber;

a needle check positioned to reciprocate in said nozzle chamber between a closed position that closes said nozzle outlet and an open position that opens said nozzle outlet, said needle check including a hydraulic lift surface exposed to said nozzle chamber;

means, within said injector body, for biasing said needle check toward said closed position;

means for stopping said plunger at a metered position between said retracted position and said advanced position;

a first supply passage connecting said actuation fluid inlet to said source of high pressure actuation fluid;

a second supply passage connecting said fuel supply passage to said source of fuel fluid different from said actuation fluid;

a drain passage that is substantially free of obstructions connecting said actuation fluid drain to said low pressure actuation fluid reservoir;

a control valve positioned in said actuation fluid cavity and having the ability to move between a first position in which said actuation fluid inlet is open and said actuation fluid drain is closed, and a second position in which said actuation fluid inlet is closed and said actuation fluid drain is open; and a computer in communication with and capable of controlling said control valve.

17. The fuel injection system of claim 16, wherein said control valve has fixed third position in which said actuation fluid inlet is closed and said actuation fluid drain is closed.

18. The fuel injection system of claim 16, wherein said intensifier piston has a single hydraulic actuation surface, and said hydraulic actuation surface is exposed to said actuation fluid cavity.

19. The fuel injection system of claim 16 further comprising means, including a spring within said injector body, for biasing said intensifier piston away from said upper position, and said spring having insufficient strength to compress fuel in said fuel pressurization chamber above a valve opening pressure that would overcome said means for biasing said needle check.

20. The fuel injection system of claim 16, further comprising:

said injector body including a fuel return passage that is substantially free of obstructions and opens into said plunger bore;

a fuel return line connected to said fuel return passage;

said plunger includes a pressure relief passage that opens on one end through said pressure face and opens on its other end through said side surface; and said pressure relief passage opens said fuel pressurization chamber to said fuel return passage when said plunger approaches said advanced position.

21. The fuel injection system of claim 16, further comprising:

means, attached to said second supply passage, for regulating the pressure of said fuel fluid.

22. The fuel injection system of claim 16 further comprising means, within said injector body, for biasing said plunger toward said retracted position.

* * * * *